5/24/83 XR 4,385,288

United States Patent [19]

Bitko

[11] 4,385,288

[45] May 24, 1983

[54] MOTION RESPONSIVE ALARM SYSTEM

[75] Inventor: Sheldon S. Bitko, East Brunswick, N.J.

[73] Assignee: Fifth Dimension, Inc., Trenton, N.J.

[21] Appl. No.: 260,195

[22] Filed: May 4, 1981

[51] Int. Cl.[3] ..... G08B 13/08

[52] U.S. Cl. ..... 340/571; 340/65; 340/566; 340/689; 340/693

[58] Field of Search ..... 340/65, 543, 566, 568, 340/571, 689, 693, 541, 546

[56] References Cited

U.S. PATENT DOCUMENTS

| | | | |
|---|---|---|---|
| 1,291,051 | 1/1919 | McQuarrie | 340/689 X |
| 3,192,517 | 6/1965 | Werlin | 340/566 X |
| 3,659,265 | 4/1972 | Eversull | 340/65 |
| 3,720,937 | 3/1973 | Lang et al. | 340/543 |
| 3,781,804 | 12/1973 | Lederer, Jr. | 340/543 |
| 3,782,148 | 1/1974 | Goldman | 340/543 X |
| 3,786,469 | 1/1974 | Massaro et al. | 340/566 X |
| 3,824,541 | 7/1974 | Nolan | 340/65 |
| 3,858,193 | 12/1974 | Bach | 340/543 X |
| 4,150,371 | 4/1979 | Scaglione | 340/568 |
| 4,282,518 | 8/1981 | Bonner | 340/546 X |

*Primary Examiner*—John W. Caldwell, Sr.

*Assistant Examiner*—Joseph E. Nowicki

*Attorney, Agent, or Firm*—Burns, Doane, Swecker & Mathis

[57] ABSTRACT

An alarm system for indicating unauthorized movement of an article includes a pendulum type motion responsive switch having a conically shaped suspended contact disposed within an annular contact. Adjustment of the height of the two contacts relative to each other provides for a variation in the sensitivity of the switch. A plurality of single-pole, double-throw switches connected in parallel with each other and having one output terminal cut or disabled to provide an open circuit condition provides for the selective disabling of the alarm system only by setting each of the switches in accordance with a predetermined key combination. All of the components of the system are self-contained on a cover that is secured to a casing which encloses the components and is attached to the article being protected. The cover is secured to the casing by bolts which form an operative component of tamper detection switches for actuating the alarm when an unauthorized attempt is made to remove the cover from the casing.

2 Claims, 5 Drawing Figures

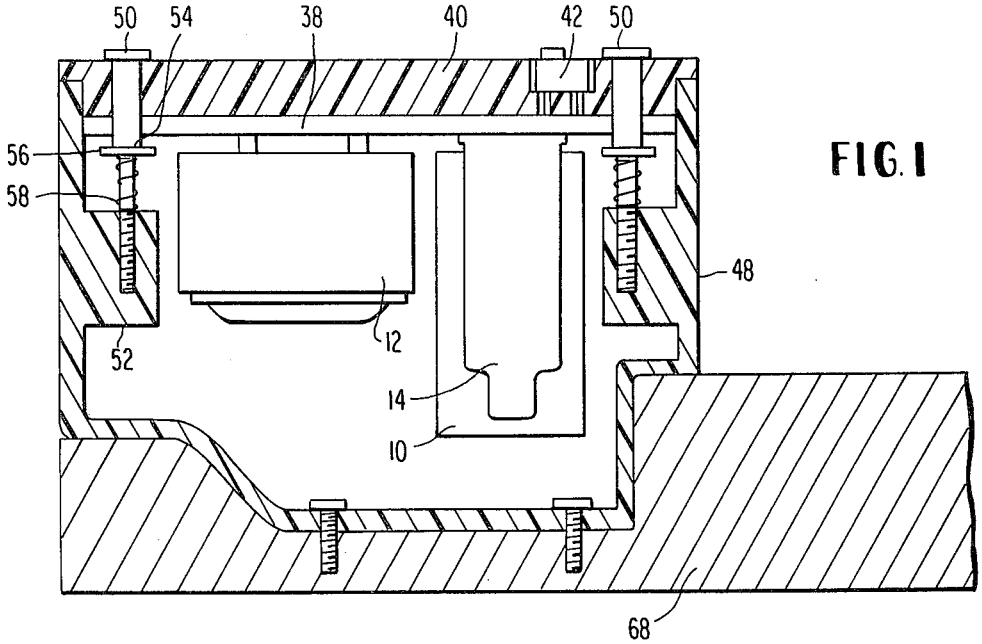
FIG. 1
FIG. 3
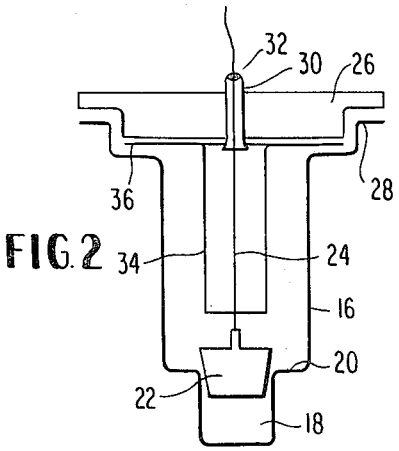
FIG. 2
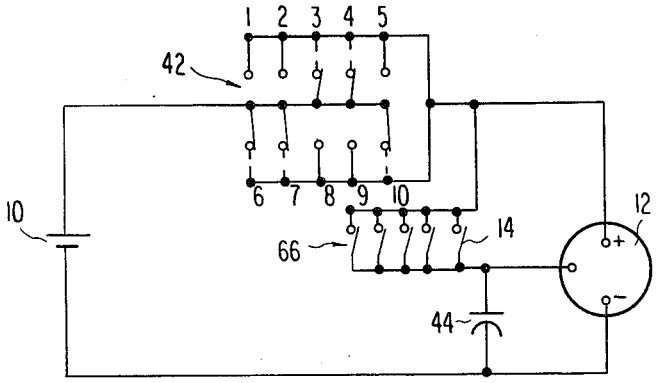
FIG. 5
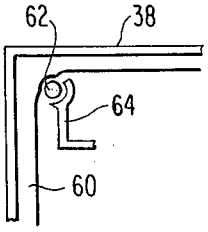
FIG. 4
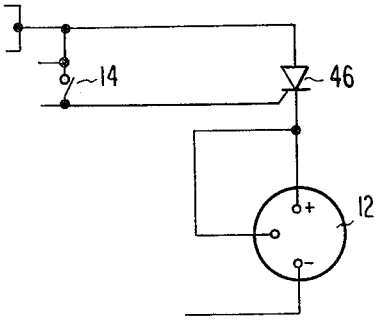

MOTION RESPONSIVE ALARM SYSTEM

BACKGROUND OF THE INVENTION

The present invention relates to an alarm system, and more particularly to an alarm system that inhibits theft of articles by sensing and indicating unauthorized movement of an article.

A variety of different types of alarms have been developed in the past to protect against the theft of various articles. Once specific area in which theft is becoming an increasing concern is in the field of office equipment, particularly for items such as typewriters and other portable word processing equipment. Because of the increasing complexity and sophistication imparted to this type of equipment as a result of technological advances, and the concurrent increase in market value of these devices, as well as the readily available market for resale, the likelihood of theft is ever increasing. It is a general object of the present invention to provide a novel alarm system that is an effective and inexpensive deterrent to the unauthorized removal of an article, such as typewriter, from its proper location.

In the past, various approaches have been taken in an attempt to provide an effective means for producing an audible or visible alarm indication upon the attempted removal of an article. In one such approach, an electrically actuated, normally closed relay was placed in series between a buzzer and a self-contained power supply, such as a battery. The control terminals of the relay were connected to the power supply of the article in which the alarm system was incorporated, and when the article was connected to a power supply, the relay would be opened and prevent the buzzer from sounding. However, as soon as the article was unplugged in an attempt to remove it from its proper location, the relay would close and the alarm would sound. This approach does not provide a totally satisfactory solution to the problem. For example, if all of the typewriters in a large office incorporated such an alarm, the resulting noise that would be generated during a power failure would be unbearable. Furthermore, this type of alarm system is not generally applicable to all types of items to be protected, but can only be utilized with devices that run on electrical power, and must be connected to their power source.

Another approach to the problem of detecting unauthorized removal of an article has been to use a normally closed push-button type switch that is disposed on the bottom of the article. When the article is placed on a desk, for example, the switch would be opened by the weight of the article and would prevent the buzzer from sounding, but would be closed to actuate the alarm once the protected article was lifted off the desk. However, a thief would be able to easily defeat such an alarm system by simply holding the button closed with his finger or a piece of tape while removing the article from the desk.

In view of the disadvantages associated with these approaches, it has been determined that a successful alarm system requires that an alarm indication should be intermittent, i.e., occur only when a contact is closed, and the contact should be closed only when the protected article is lifted or otherwise moved. A position sensitive type of switch best fulfills these requirements. With this in mind, different types of mercury switches, to control the supply of power to a buzzer upon detection of movement of an article, were tried. However, in almost all cases, the mercury switches did not provide fully satisfactory results. It was found that some switches are not sensitive enough, and the article can be easily lifted and carried away without actuating the alarm by exercising a certain amount of caution in the handling of the article. Other sources were found to be too sensitive, and caused too many false alarms. For example, when the alarm system is incorporated in a typewriter, the vibration imparted to the typewriter during normal use was sufficient to cause the mercury switch to actuate the alarm.

The type of switch that has been found to best meet the requirements of the present invention is a motion and tilt responsive pendulum switch, i.e., a switch that includes a suspended contact or contact actuator. This type of switch is insensitive to short term impact such as that occurring during the striking of typewriter keys or closing of a desk drawer, is responsive to a small degree of tilt and is sensitive to motion, due to the inertia of the suspended contact.

Pendulum type switches have been used in alarm systems in the past. See, for example, U.S. Pat. No. 3,772,645. However, another feature of the present invention that distinguishes it from prior art alarm systems such as the one shown in that patent relates to specific details of the switch and the manner in which the components forming the system are packaged. More specifically, the overall packaging of the alarm system is significant in that it determines the susceptibility of the system to being disabled or otherwise tampered with. For example, if the packaging of the alarm system permits unauthorized disconnection of the power supply from the alarm indicator without actuating the motion sensitive switch, the alarm system will be ineffective for its intended purpose. In addition, the means for disarming, or deactuating, the alarm system must not be easily susceptible to unauthorized use.

It is therefore a general object of the present invention to provide a novel alarm system that produces an audible or visible indication upon detection of the unauthorized movement of an article to be protected.

It is another object of the present invention to provide such an alarm system that is responsive to unauthorized movement of an article but does not produce false alarm indications in response to vibrations caused by ordinary use of the article.

It is a further object of the present invention to provide such an alarm system that is capable of being utilized in a variety of different applications.

It is yet another object of the present invention to provide a novel alarm system that is relatively simple and inexpensive, and therefore not limited to practical use with only expensive items.

It is still another object of the present invention to provide a novel alarm system that is packaged in a manner which inhibits unauthorized disarming of the system.

It is still a further object of the present invention to provide a novel switching system for coded disarmament of an alarm system.

The manner in which the present invention achieves these and other objects and advantages will be apparent from a perusal of the following description of the preferred embodiment of the invention, when taken in conjunction with the accompanying figures.

BRIEF DESCRIPTION OF THE DRAWINGS

FIG. 1 is a sectional side view of an alarm system incorporating the present invention;

FIG. 2 is a sectional side view of a preferred embodiment of a motion sensitive switch;

FIG. 3 is a schematic circuit diagram of one embodiment of an alarm system that operates in an intermittent mode;

FIG. 4 is a partial schematic circuit diagram of an alternate embodiment of an alarm circuit that operates in a latching mode; and FIG. 5 is a plan view of a portion of a circuit board illustrating the location of conductors forming part of the tamper detection switch.

DETAILED DESCRIPTION

In the following detailed description of its preferred embodiment, the invention is described with specific reference to its use as a typewriter alarm where such description facilitates an understanding of the invention. However, it will be appreciated by those of ordinary skill in the art that the invention is not limited to this particular field of use but is generally applicable in preventing the theft of almost any type of portable device. For example, the alarm system can be utilized to inhibit theft of television and furniture from hotel rooms and stores, artifacts from museums, and can be placed in a briefcase or luggage to detect unauthorized movement. With a proper gimbal arrangement for support, it is also possible to use it in automobiles.

Referring generally to FIG. 1, the physical arrangement of the components forming an alarm system constructed in accordance with the present invention is illustrated. The three basic components of the alarm circuit are a self-contained power supply 10, an indicator 12, and a motion sensitive pendulum type switch 14. The power supply 10 can be a conventional 9-volt battery and preferably should provide sufficient power to keep the alarm system operative for a period of at least one year. The indicator 12 can be any conventional type of buzzer that provides an audible signal upon the application of a trigger signal. It is possible to use a visual indicator, such as a light source, as well.

A preferred embodiment of a motion sensitive switch for applying a trigger signal to the indicator 12 is illustrated in greater detail in FIG. 2. The switch includes an outer shell, or can, 16 of cylindrical configuration. The lower portion 18 of the can is of reduced inside diameter to define a circular shoulder 20 that provides an annular contact surface. The can 16 is preferably made from a thin sheet of metal that can be stamped into the shape illustrated in FIG. 2. Alternatively, the can 16 can be formed by boring a cylinder so that the lower portion will have a smaller inside diameter, to thereby provide the shoulder 20.

The other contact of the switch is formed by metal weight 22 suspended from the top of the switch by a flexible conductor 24. In its most preferred form, the contact 22 is in the shape of a cone, or truncated cone, with its apex facing down. This shape offers two significant advantages. First, by varying the height of the contact 22, the distance between its conical surface and the annular contact surface formed by the shoulder 20 can be varied, to thereby vary the sensitivity of the switch to tilt and motion. For example, by raising the contact 22, a greater amount of angular tilt will be required to close the contacts of the switch. Second, by suspending the cone with its apex down, it is inherently insensitive to low level vibration. It is believed that the insensitivity of the switch to vibration is due to the relatively high center of gravity of the contact 22 when it is suspended in the position shown in FIG. 2, causing it to be relatively unstable. When the switch is hit or otherwise caused to vibrate, the inverted conical shape of the contact 22 causes it to rock around its center of gravity, because it tends to tip over, rather than sway, which it would do if it had low center of gravity. The rocking of the contact 22 about its center of gravity limits its overall movement, and thereby keeps the contacts of the switch apart when the switch is vibrated. However, if the switch is tilted, the contacts of the switch will be closed.

Thus, for example, if the alarm system is incorporated in a typewriter, the normal vibration imparted to the typewriter during operation would not cause the switch to close, but any tilting of the typewriter that may be occasioned by lifting or otherwise moving it will cause the contacts to close. Further details of a switch such as that illustrated in FIG. 2 can be found in copending Application Ser. No. 229,942, filed by David Bitko on Jan. 30, 1981.

In addition to the two structures forming its respective contacts, the switch also includes a header 26 made of glass or other insulating material that is hermetically sealed to a flange 28 provided on the upper portion of the can 16. The hermetic sealing of the header 26 to the can 16 prevents oxidation of the contact points of the switch. In addition, it enables the interior of the can 16 to be filled with a liquid such as oil, for example, to provide further insensitivity to vibration when the switch is to be used in an area where significant vibration is present. A metal tube 30 is supported in the center of the header 26 by a hermetic insulator that electrically isolates it from the can 16. The conductor 24 passes through the tube 30 and is attached to the tube by means such as solder 32 to fix the position of the contact 22. The use of solder to fix the conductor 24 to the tube 30 provides for relatively easy adjustment of the sensitivity of the switch. The bottom of the tube 30 is preferably flared to reduce the possibility of damage to the conductor 24.

The switch 14 can also include a sleeve 34 that extends from the top of the can along a substantial portion of the length of the conductor 24. The sleeve 34 preferably has a flange 36 that is positioned between the can 16 and the header 26 to hold it in place. The purpose of the sleeve 34 is to prevent excess movement of the contact 22, to thereby keep the suspended contact 22 in the aperture of the annular contact and to inhibit possible tangling or damage to the conductor 24 when the alarm unit is turned upside down, for example.

A motion, or angular position, sensitive switch 14 can be constructed in a shape other than that shown in FIG. 2. For example, if it is not desired that the switch have adjustable sensitivity, the stationary contact, or can 16, can be of uniform internal diameter, rather than providing a shoulder 20, and the suspended contact 22 need not be conically shaped. In another alternative embodiment, the outer shell and the suspended member need not form the electrical contacts of the switch. For example, a light source and a light detector can be disposed on diametrically opposite sides of the shell, and the suspended member can be disposed between them when the switch is in its normally open position. In this embodiment, any tilting of the switch will cause the suspended member to move out of the path of the light beam from the light source and allow it to impinge on the light detector, to thereby form an electrical signal that is the equivalent of that produced upon the closure of two switch contacts.

Referring again to FIG. 1, the battery 10, buzzer 12 and switch 14 are mounted on a printed circuit board 38. The board 38 in turn is mounted on a cover 40 for the alarm system. The cover 40 also supports a number of single-pole, double-throw key switches 42. These switches are connected to the electrical circuit for the alarm system and provide a means for selectively disabling the alarm system from the exterior of the unit. In a preferred embodiment of the invention, a type of single-pole, double-throw switch commonly referred to as a "DIP" switch is used for each of the key switches, because of its relatively small size and cost, among other reasons.

The schematic circuit diagram of the alarm system shown in FIG. 3 illustrates the manner in which the key switches 42 can be connected to the circuit to selectively disable the alarm system by actuating the switches according to a predetermined combination. In the illustrated embodiment, five key switches are connected in parallel with one another. The common terminals of the switches are connected together and to one terminal, e.g., positive, of the power supply 10. The output terminals of the switches are connected to each other and to the positive terminal of the buzzer 12. For each switch, the lead for one output terminal is removed or severed, i.e., the output terminal is open circuited, so that when the common contact is switched into connection with the open circuited output terminal, no electrical connection between the power supply and the buzzer will be made by that switch. Alternatively, a gap can be left in the conductor on the circuit board that is connected to one of the output terminals, to provide the open-circuit condition. Each of the two possible positions for each switch can be appropriately numbered, as illustrated in FIG. 3, in accordance with a code for the predetermined combination for disarming the alarm.

In the illustrated embodiment, the combination for disarming the alarm is 6, 7, 3, 4, 10. In other words, when the respective switches are set to the positions of the combination, each common contact will be connected to its respective open-circuited output terminal, and no electrical power will be supplied to the buzzer 12. However, if any one or more of the switches is switched over to its other position, power will be supplied to the buzzer and the alarm system will be armed.

From the foregoing it will be apparent that the particular lead of each switch that is removed will determine the disarming combination for the particular alarm system in which it is incorporated. This arrangement of the switches provides an effective measurement of security against unauthorized disarming of the system. For example, in a switch arrangement utilizing five switches, there are 32 different possible switch position combinations, only one of which will disarm the circuit. The addition of another switch to the disarming switch assembly would double the number of possible switch combinations, and therefore further decrease the probability that the correct combination could be guessed by unauthorized personnel. Thus, for example, 10 key switches connected in parallel will provide 1024 different possible switch position combinations, only one of which will disarm the circuit.

It will be appreciated that a plurality of single-pole, double-throw switches each having one open-circuit output terminal can also be used to provide a secure means for selectively applying power to an electrical component. In such a case, each of the switches are connected in series rather than in parallel, i.e., the output terminals of the first switch are connected to the common terminal of the second switch, etc. With this arrangement, all of the switches must be positioned according to a predetermined combination that places the common terminal of each switch in electrical connection with its associated closed-circuit output terminal to supply power to the electrical component. If any one or more switches are in their respective open-circuit position, the supply of power will be interrupted. This type of arrangement would be useful in a situation where it is desirable to protect a piece of electrically powered equipment, such as a typewriter, for example, from unauthorized use. It is also possible to use such a switch arrangement in a larger system, for example a hi-fi, that requires more current than that for which the key switches are rated. In such a case, the key switches can function as a pilot control to control the supply of low current power to a load carrying relay or transistor that conducts the higher valued current.

The removal or severing of leads to open certain ones of the output terminals, for example during manufacture, permanently fixes the combination of switch positions necessary to activate the key switch. Where a programmable key combination is desirable, both output terminal leads for each switch can be severed or removed, and screws or shorting bars can be used to reconnect one of the two severed leads for each switch to program the desired combination into the key switch arrangement.

The motion sensitive switch 14 is connected between the output terminals of the dip switches 42 and the trigger terminal of the buzzer 12. When the alarm system is armed by means of the dip switches 42, a closure of the contacts of the motion sensitive switch 14 will apply a trigger signal to the buzzer 12, causing it to sound an alarm. In the embodiment illustrated in FIG. 3, the operation of the alarm is intermittent in that the buzzer is actuated only while the contacts of the motion sensitive switch 14 are closed. As soon as they open, the trigger signal to the buzzer will be interrupted and the buzzer will stop sounding an alarm.

It has been found in some applications that the inherent vibration produced by the buzzer during actuation is sufficient to impart vibratory movement to the entire alarm system package, and thereby cause the contacts of the switch 14 to vibrate open. As a result, the continuous opening and closing of the switch 14 causes the buzzer to produce a somewhat dull, muted sound. In order to overcome this type of operation, a capacitor 44 can be connected between the trigger terminal of the buzzer and the negative power supply terminal. It is believed that the capacitor 44 increases the effective time constant of the trigger circuit so that a continuous trigger signal is applied to the buzzer even during the intermittent bouncing of the contacts of the motion sensitive switch 14.

An alternative to the intermittently operating embodiment of FIG. 3 is illustrated in FIG. 4. In this embodiment, a thyristor or SCR 46 is inserted in series between the output terminals of the switches 42 and the positive terminal of the buzzer 12. The motion sensitive switch 14 is connected in series between the output terminals of the switches 42 and the gate terminal of the thyristor 46. The cathode of the thyristor is connected to both the positive and trigger terminals of the buzzer 12. In operation, when the alarm system is armed and the contacts of the motion sensitive switch 14 are closed, the switch will apply a trigger signal to the thyristor 46, causing it to become conductive to apply power and a trigger signal to the buzzer 12, thereby actuating it. Any subsequent opening of the contacts of the switch 14 will not have any effect upon the thyristor 46, and it will continue to supply a trigger signal to the buzzer 12. Thus, the embodiment of FIG. 4 operates in a latching mode, rather than an intermittent mode, and once the alarm is actuated it can only be turned off by properly setting the dip switches 42 to the disarming combination. This mode of operation may be more desirable in those applications in which it is not inconvenient or cumbersome to have a person with knowledge of the disarming switch combination summoned to disarm the alarm.

Referring again to FIG. 1, the cover 40 is secured to a casing 48 which, together with the cover, completely encloses the components of the alarm system. The cover 40 is secured to the casing 48 by means of bolts or screws 50 that are threaded into projections 52 in the interior of the casing. The lower, threaded portion of each bolt 50 has a smaller diameter than the upper portion of the shaft of the bolt that passes through the cover 40, to thereby provide a shoulder 54 on the shaft of the bolt. An electrically conductive washer 56 is inserted on each bolt and rests against the shoulder 54. A spring 58 is disposed on the lower portion of the bolt 50 between the projection 52 and the washer 56 and urges the washer into engagement with the shoulder 54.

Referring to FIG. 5, a portion of the printed circuit board 38, that operates in conjunction with the shouldered bolt 50, the washer 56 and the spring 58 to form a tamper detection switch, is illustrated. The periphery of the circuit board includes a first conductor 60 that is in electrical connection with one of the two contact terminals of the motion sensitive switch 14 and lies adjacent to a hole 62 in the circuit board through which one of the bolts 50 passes. A second conductor 64 is located on the diametrically opposite side of the hole 62 from the first conductor 60. The second conductor 64 is insulated from the first conductor 60 and is in electrical connection with the other contact of the motion sensitive switch 14.

When the alarm system is assembled as illustrated in FIG. 1, the washers 56 are held out of engagement with the printed circuit board by means of the shoulders 54 on the bolts 50. However, if an attempt is made to disassemble the alarm system by unscrewing the bolts 50 to remove the cover 40, a spring 58 will push a washer 56 into engagement with the circuit board as a bolt 50 is unscrewed from the projection 52, causing the washer to electrically bridge the gap between the two conductors 60 and 64 in the corner of the circuit board. Upon engagement of the washer 56 with the two conductors 60 and 64, a trigger signal will be applied to the buzzer 12 to actuate the alarm. The two conductors and the washer effectively form a tamper-detection switch 66 that is in parallel with the motion sensitive switch 14. If the cover 40 is secured to the casing 48 by means of four bolts, the four tamper detection switches 66 would all be in parallel with each other and the motion sensitive switch 14, as illustrated in FIG. 3.

The casing 48 is preferably attached to the article to be protected, for example the base 68 of a typewriter, by means such as screws that are accessible only from the interior of the casing. Once secured to the article, the cover, with the attached components of the alarm system, is secured to the casing by the bolts 50. Thus, it is not possible to remove the alarm system from the article 68 without first removing the cover 40, which would cause the alarm to be actuated if the system is not first disarmed by means of the key switches 42.

The alarm system is basically self-contained as a unit on the cover 40, i.e. the circuit board 38, the electrical components, and the bolts 50 are all supported on the cover. This feature of the invention offers a significant advantage from a manufacturing standpoint, as well as the previously discussed advantage of inhibiting removal of the alarm system from the article. More specifically, by having the system as a self-contained unit on the cover, a large number of standard units having the same size and physical layout can be easily produced. It is only necessary to custom produce the casing 48 so that it can be easily fitted onto the article to be protected. The ability to mass produce a substantial portion of the alarm system, and the necessity of custom fitting only a single piece thereof, significantly reduces the overall cost associated with the system.

The present invention may be embodied in other specific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An alarm system for preventing unauthorized movement of an item, comprising:

a support member;

a motion responsive switch including an annular contact mounted to said support member, and a movable contact suspended within said annular contact;

a self-contained power supply operatively connected to one of said contacts;

means for providing an alarm indication operatively connected to the other of said contacts so that upon closure of said contact power is supplied to said indicating means;

means for selectively disabling the supply of power to said indicating means;

a casing for supporting said support member and enclosing said switch, said power supply and said indicating means and adapted to be disposed on the item such that said support member is normally disposed in a position wherein said movable contact is suspended within the aperture of said annular contact and out of physical engagement with the surface of said annular contact;

said support member including a cover adapted to be secured to said casing; and a tamper detection switch comprised of a bolt passing through said cover and adapted to be threaded to said casing, a pair of electrically isolated conductors disposed adjacent said bolt, a washer disposed on said bolt so as to be held out of engagement with said conductors when said bolt is threaded to said casing, and means for urging said bolt into engagement with said conductors when said bolt is unscrewed from said casing.

2. The alarm system of claim 1 wherein said tamper detection switch is connected in parallel with said motion responsive switch.

* * * * *